US005876283A

United States Patent [19]

Parra et al.

[11] Patent Number: 5,876,283

[45] Date of Patent: Mar. 2, 1999

[54] CASINO PROGRESSIVE BACCARAT GAME METHOD OF PLAY

[76] Inventors: Anthony C. Parra; Debra L. Parra, both of 1101 Iroquois Ave., #1209, Naperville, Ill. 60563

[21] Appl. No.: 961,357

[22] Filed: Oct. 30, 1997

[51] Int. Cl.[6] ..... A63F 1/00

[52] U.S. Cl. ..... 463/12; 463/27; 463/42; 273/292

[58] Field of Search ..... 273/292; 463/12, 463/13, 26, 27, 42

[56] References Cited

U.S. PATENT DOCUMENTS

| | | | |
|---|---|---|---|
| 4,659,087 | 4/1987 | Shen et al. | 273/274 |
| 5,048,833 | 9/1991 | Lamle | 273/143 R |
| 5,092,598 | 3/1992 | Kamille | 273/139 |
| 5,332,219 | 7/1994 | Marnell, II et al. | 463/13 |
| 5,350,175 | 9/1994 | DiLullo et al. | 273/146 |
| 5,362,064 | 11/1994 | Lofink et al. | 273/292 |
| 5,393,057 | 2/1995 | Marnell, II | 273/269 |
| 5,395,119 | 3/1995 | Jacob et al. | 273/274 |
| 5,407,199 | 4/1995 | Gumina | 273/139 |

OTHER PUBLICATIONS

"Scarney Baccarat", Scarne's Encyclopedia Of Games, John Scarne, Harper & Row Publishers, pp. 297–302, Dec. 1973.

"9's Up", Harrah's Lake Tahoe Resort Casino, Harrah's Gaming Guide, Dec. 1988.

*Primary Examiner*—Benjamin H. Layno

*Attorney, Agent, or Firm*—Meroni & Meroni

[57] ABSTRACT

An improved method of playing the conventional manner of play of baccarat and game table apparatus in which a bettor makes a first wager that either a bank hand or player hand will win, the improvement comprising: the bettor having the option of making a second wager that the bank hand and the player hand will comprise in combination a four-of-a-kind of a specific card value, dealing two cards comprising the bank hand and dealing two cards comprising the player hand according to the conventional manner of play of baccarat, determining whether the combination of the bank hand and the player hand is a four-of-a-kind of the specific card value, paying off the bettor a predetermined amount if the bettor's second wager was a winning wager wherein the combination of the bank hand and the player hand is a four-of-a-kind of the specific card value, dealing an additional card to the player hand and an additional card to the bank hand if required according to the conventional manner of play of baccarat, determining a winning hand and a losing hand according to the conventional manner of play of baccarat, paying off the bettor a predetermined amount if the bettor's first wager was on the winning hand according to the conventional manner of play of baccarat and collecting the amount wagered on the losing hand. The game table apparatus comprising: a game board having a generally semicircular peripheral edge about which a plurality of players are located, the game board having designated thereon a series of bet placing boxes corresponding to each of the players and a plurality of ornamental designs corresponding to each of the players, each of the ornamental designs being located at each of the bet placing boxes.

13 Claims, 3 Drawing Sheets

CASINO PROGRESSIVE BACCARAT GAME METHOD OF PLAY

BACKGROUND OF THE INVENTION

1. Field of the Invention

The present invention is generally directed to a method of play and apparatus for playing a casino game of chance. In particular, the present invention relates to a baccarat game and table layout for mini-baccarat or baccarat.

Moreover, the present invention will be specifically directed to a method of play that provides for an additional side wager or progressive bet to entice players to make additional wagers to receive a predetermined reward.

Also, the present invention will specifically be directed to a method of play that provides for an additional side wager, such as a progressive bet or a proxy progressive bet to entice players to make additional wagers to receive a predetermined reward facilitated by the application of a keypad to process and record all progressive bets electronically.

Furthermore, in order to stimulate and create more interest to the traditional method of playing baccarat, the present invention will introduce:

(1) A baccarat marker;

(2) A baccarat bet box;

(3) A baccarat table layout; and (4) A baccarat tie call.

2. Description of the Prior Art

Baccarat is one of the more popular gambling games played in casinos or gaming establishments. As is well known, the game is played on an elongated table having a game board displayed along the upper surface of the table. The game board displays certain wagering areas, and the elongated table allows for the seating of multiple players or bettors (1–16) and the positioning of the multiple dealers (3) necessary for operating the casino game. Bettor locations are typically numbered on the table and each bettor location has an area designated for a wager on the bank hand and an area designated for a wager on the player hand. Baccarat uses a standard deck of 52 playing cards and is usually dealt from a shoe having multiple decks that have been shuffled together prior to the beginning of play.

The object of the game of baccarat is for the bettor to successfully wager on whether the bank's hand or the player's hand is going to win. The bettor receives even money for his wager if he selects the winning hand and loses his wager if he selects the losing hand. Because of the rules of play of baccarat, the bank's hand has a slightly higher chance of winning than does the player's hand. Therefore, if the bettor wagers on the bank's hand, the bettor is required to pay to the gaming establishment a commission (typically 5%) of the amount the bettor wins. No commission is paid if the bettor successfully wagers on the player's hand.

As disclosed in this specification, the term "conventional manner of play of baccarat" is as follows:

A multiple number of decks of standard playing cards, 52 in number, are used; typically six to twelve decks are shuffled together and placed in a shoe from which the cards are dealt during the play of the game.

Each bettor makes a wager on whether the bank's hand or the player's hand will win. After all wagers are made, two cards are dealt from the shoe to the bank position and two cards are dealt from the shoe to the player's position on the table layout. The cards are turned face up and the value of the bank hand and the player hand is determined.

Aces count as one; kings, queens, jacks and tens count as zero and the other cards count as their respective face value.

The suits (hearts, diamonds, spades and clubs) have no meaning in baccarat. The highest hand value in baccarat is nine. All hand values range from a low of zero to a high of nine. If when the cards are added together, the total of the hand exceeds nine, then the hand value is determined by subtracting ten from the total of the hand. For example, a seven and nine total sixteen, but the hand value is six. An Ace and a nine total ten, but the hand value is zero.

A two card total of eight or nine is called a "natural"; a two card total of zero is called a "baccarat". As will be explained hereafter, in certain situations in the play of the game, a third card will be dealt. The value of this third card is added to the total of the first two cards and a new hand value is established. Again, if the new hand total exceeds nine, the hand value is determined by subtracting ten from the total of the hand.

Prior to the deal, each bettor can make one of three wagers: 1) that the bank hand will win; 2) that the player hand will win; or 3) that the bank hand and the player hand will tie. Wagering locations are provided on the baccarat table layout. Whichever of the bank hand or the player hand is closest to a total of nine is the winner.

All winning bank hand wagers are paid off at odds of one-to-one and the house charges a five percent (5%) commission on the amount won by the bettor. For example, if a bettor wagers $100 on the bank hand and the bank hand wins, the bettor wins $100 and is charged a $5 commission on the amount that the bettor won. The bettor is not charged any commission on the amount of his wager.

All winning player hand wagers are paid off at odds of one-to-one and the bettor is not charged any commission on the amount of his winnings or his wager. Winning wagers on the tie hand bet are paid off at odds of eight-to-one (depending on the gaming establishment) and the bettor is not charged any commission on the amount of his winnings or his wager. If a tie hand occurs, all wagers on the bank hand and all wagers on the player hand are "pushes" and the amount wagered is returned to the bettor.

The play of baccarat typically uses three casino dealers to operate the game. The casino dealers jointly participate in the shuffling of the decks of cards. After the shuffle is completed, one of the players is typically asked to cut the decks using a plastic cut card. The dealer then separates and restacks the cards from the point of the cut and the dealer or a player then inserts the plastic cut card no less than fifteen cards from the ends of the stacked decks and the entire stacked decks are placed into a shoe from which the cards are dealt during the play of the game. When the inserted plastic cut card appears during play, the hand in progress is completed and that round of play then ends. The cards are reshuffled to prepare for the next round of baccarat.

In conventional baccarat, the bettors deal the cards used in the game. Initially, one of the casino dealers (called the "caller") passes the shoe to the bettor sitting in seat number "1" at the baccarat table. After all wagers have been made, the caller tells the bettor with the shoe to begin the deal. The bettor deals a first card to the caller, a first card to himself, a second card to the caller and a second card to himself. All cards are dealt face down. The two cards given to the caller represent the player hand and the two cards kept by the bettor who is dealing the cards represent the bank hand.

The caller than allows one of the other bettors to turn up the player's hand. Traditionally, this honor is given to the bettor who has made the largest wager. The bettor turns up the two cards of the player's hand and tosses them to the caller. The caller places these two cards face up in the table location designated for the "player hand" and the caller announces the point total of the player hand.

The bettor who has the shoe then turns over the cards of the bank hand and tosses these two cards to the caller. The caller places these two cards face up in the table location designated for the "bank hand" and the caller announces to point total of the bank hand. Depending on the point total of the player's hand and the bank's hand, one more card may be dealt to either the player's hand, the bank's hand or both. The rules for determining whether a third card is dealt are fixed rules, there is no discretion for either the player's hand or the bank's hand on whether a third card is dealt.

If either the player hand or the bank hand has a point total of eight or nine on the first two cards, no third card is dealt to either hand and the hand with the highest point total is the winner (or the hand is a tie, as the case may be). If neither the player hand or the bank hand has a point total of eight or nine, then there is a possibility of a third card draw.

The third card draw rules are as follows:

Rule #1: If the initial two card player hand has a point total of 0, 1, 2, 3, 4 or 5, draws a third card. If the initial two card player hand has a point total of 6 or 7, the player hand stands and does not receive a third card.

Rule #2: If the player hand stands and does not draw a third card, then the bank hand follows Rule #1. In other words, if the player hand has a point total of 6 or 7, the bank hand draws a third card on a point total of 0, 1, 2, 3, 4 or 5 and the bank hand stands on a point total of 6 or 7.

Rule #3: If the player hand draws a third card, the bank hand must draw or stand as follows:

| Bank hand two card point total | Bank hand draws when the player's hand third card is: | Bank hand stands when the player's hand third card is: |
|---|---|---|
| 0, 1 or 2 | Bank always draws | — |
| 3 | 0, 1, 2, 3, 4, 5, 6, 7 or 9 | 8 |
| 4 | 2, 3, 4, 5, 6 or 7 | 0, 1, 8 or 9 |
| 5 | 4, 5, 6 or 7 | 0, 1, 2, 3, 8 or 9 |
| 6 | 6 or 7 | 0, 1, 2, 3, 4, 5, 8 or 9 |
| 7 | — | Bank always stands |

All third card draw determinations are automatically made by the caller who is skilled in the game of baccarat. When the rules of baccarat require a third card for the player hand, the caller will request a card for the player hand. After the player hand is completed, the bank hand is completed in the same fashion. The caller then declares which hand has the highest point total and declares that hand the winner (or the caller declares a tie hand as the case may be).

In conventional baccarat the bettor who acts as the dealer continues to deal the cards until the player hand wins. As soon as the player hand wins, it is customary to pass the shoe counterclockwise around the baccarat table to the next bettor so that each bettor has the opportunity to deal the cards. Any bettor may decline to deal the cards. The fact that one of the bettors is physically dealing the cards has no affect on the outcome of the game because the rules for drawing and standing do not allow any discretion on the part of the players.

However, the use of the standard elongated baccarat table has several drawbacks. For example, the typical baccarat table is elongated primarily to provide seating capacity for multiple players; however, due to business levels, it is often necessary to close down the table for lack of adequate play which results in loss of revenue. In gambling locations where space is limited, such as river boats, the amount of space a gaming establishment can provide becomes invaluable. In such instances, many casinos have been forced to resort to "mini-bac" tables which allow for approximately one-half the players and ultimately destroys the excitement of the game as the rules and play of the game have to be modified extensively. For instance, players are typically not allowed to handle the cards and pass the shoe from player to player.

Also, because the standard baccarat table is elongated, the table is typically formed with two betting areas on either end and a central area for player hand and bank hand placement. Four baccarat table operators are typically used to run a standard baccarat table, this would include three dealers (one of which is a caller), and a relief. The necessity of using four people to monitor the typical baccarat table lowers the profitability of these standard baccarat tables.

Since none of the players have any affect on how the cards are played, the most significant interaction or only interaction the players have in the game of baccarat is on placing bets. Therefore this game is not always an extremely popular gaming table at certain gaming establishments. Gaming establishments have provided additional wagering features on other types of games such as slot machines in order to entice players to make additional wagers and allow the players to win an additional reward from a "progressive" jackpot. Various modifications to the game of baccarat have been proposed in the past to eliminate the 5% house commission and provide for additional side wagers; however, none of these modifications have proven to be widely accepted or successful.

Furthermore, the standard baccarat tables and the mini-bac tables have a standard layout of numbers representing each player and also include betting boxes for wagering on a banker's hand, player's hand, and a tie. The aesthetic view of these table layouts is rather ordinary and plain and is not specifically designed to entice other people to play unless they understand how baccarat is played. In the case of using a larger baccarat table wherein three dealers are required, the layout of the table provides for betting areas on two opposite ends of the table. This particular layout can make it difficult for the dealers to adequately monitor all the bets since each dealer has to continually look to the sides to view the players' bets. This can cause confusion created by vague and unclear betting areas.

These and other types of baccarat games and table layouts disclosed in the prior art do not offer the flexibility and inventive features of our baccarat game method of play and apparatus. As will be described in greater detail hereinafter, the baccarat game method and table layout of the present invention differs from those previously proposed.

SUMMARY OF THE INVENTION

According to our present invention we have provided an improved method of playing the conventional manner of play of baccarat in which a bettor makes a first wager that either a bank hand or player hand will win, the improvement comprising:

a) the bettor having the option of making a second wager that the bank hand and the player hand will comprise in combination a four-of-a-kind of a specific card value;

b) dealing two cards comprising the bank hand and dealing two cards comprising the player hand according to the conventional manner of play of baccarat;

c) determining whether the combination of the bank hand and the player hand is a four-of-a-kind of the specific card value;

d) paying off the bettor a predetermined amount if the bettor's second wager was a winning wager wherein the combination of the bank hand and the player hand is a four-of-a-kind of the specific card value;

e) dealing an additional card to the player hand and an additional card to the bank hand if required according to the conventional manner of play of baccarat;

f) determining a winning hand and a losing hand according to the conventional manner of play of baccarat;

g) paying off the bettor a predetermined amount if the bettor's first wager was on the winning hand according to the conventional manner of play of baccarat and collecting the amount wagered on the losing hand.

Another object of the present invention is to provide a modified method of play of conventional baccarat that introduces the option for a player to make additional wagers with the possibility of winning an additional predetermined jackpot.

In addition, it is advantageous to provide the typical "mini-bac" game with an additional pay out. The chance of an additional reward in addition to the typical baccarat rewards, may entice gamblers to make wagers and also to wager for longer periods of time.

It is a further object of the present invention to provide an improved baccarat table layout which improves the functionality and aesthetics of the game by preventing disputes caused by confusion, due to vague or unclear betting areas, which might result in loss of bets or winnings to the guest and the casino.

It is yet another object of the present invention to provide an improved method of playing baccarat wherein an additional reward is attained without completing a "hand" or requiring the player to complete a complex predetermined selection of cards to qualify for an additional progressive reward.

It is also an object of the present invention to provide an electronic keypad to facilitate in the processing and recording of the progressive betting of the game.

Other objects, features and advantages of our invention will become more readily apparent upon reference to the following description when taken in conjunction with the accompanying drawings, which drawings illustrate several embodiments of our invention.

DETAILED DESCRIPTION OF THE PREFERRED EMBODIMENT

Figure 1:
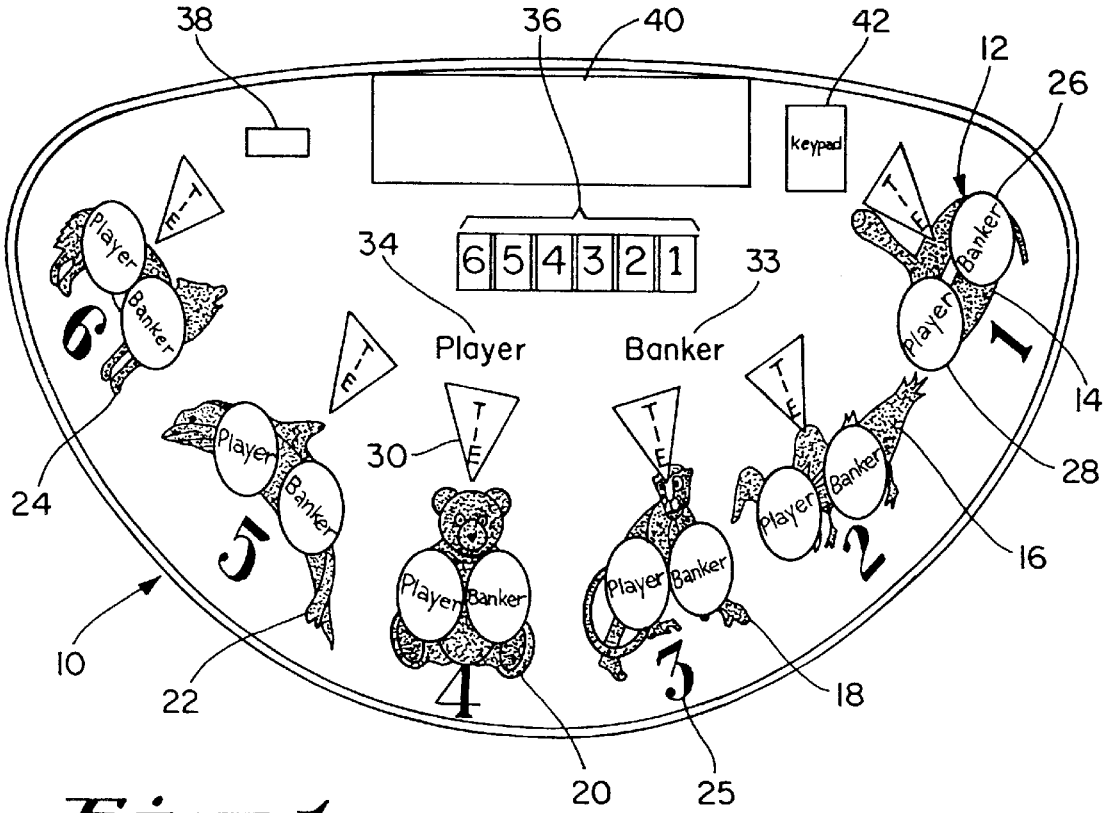
FIG. 1 is a gaming table layout that can be used in connection with the modified method of baccarat of the present invention.

Referring now to the drawings, FIG. 1 shows our new and improved baccarat table apparatus 10 including a gaming table having a generally horizontal replaceable playing surface forming a generally arcuate peripheral edge about which a plurality of bettors are located. A game board is displayed on an upper surface of the table with the board having designated thereon a first series of individual baccarat bet placing areas 12 positioned in a repetitive pattern along a portion of the table extending along the arcuate peripheral edge.

The baccarat table layout in the present invention will enhance the method of play by providing both functionality and aesthetics to an already exciting and popular game. Moreover, this particular table layout will provide the bettors a distinguishing factor in their choice of sitting position as each position will correspond to an animal, plant, mineral, or any other symbol, caricature, or likeness deemed suitable and lending itself to holidays, sports, types of automobiles, clothing, etc., and thus, create a loyalty following for each of those positions. The table layout shown in FIG. 1 displays six bettor locations wherein each location corresponds to a particular animal. In this particular instance, bettor position 1 corresponds to a snake 14; bettor position 2 corresponds to a pair of ducks 16; bettor position 3 corresponds to a monkey 18; bettor position 4 corresponds to a bear 20; bettor position 5 corresponds to a dolphin 22; and bettor position 6 corresponds to a wolf 24.

Figure 2:
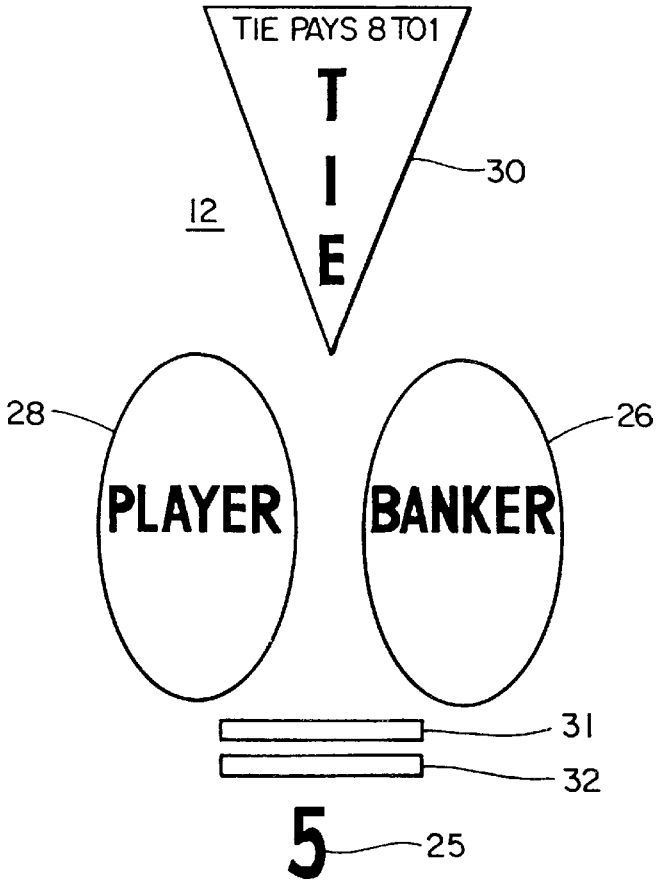
FIG. 2 is an enlarged view of a bet box positioned in front of each player that can be used in connection with the present invention.

Each bettor location is identified by a seat number 25 and has an area designated for a wager on the bank hand 26 and an area designated for a wager on the player hand 28. An area 30 is also provided in which bettors may wager that a "tie" hand will occur (FIGS. 1 and 2). Two slots 31, 32 are provided at each bettor location to allow each player to make additional side wagers, such as a progressive wager or a progressive proxy wager. To make an additional side wager, the player must place his or her chip into the selected slot area 31, 32. There is also provided an area 33 where the cards comprising the bank hand can be displayed and an area 34 where the cards comprising the player hand can be displayed (FIG. 1). Also, along the center portion of the table are number of commission boxes or "vig" boxes 36 corresponding to the number of bettor positions on the table. The commission boxes allow the casino dealers to keep track of any accrued commissions or vigorish owed to the gaming establishment by each player.

Next to the dealer's location, there is normally provided one or more drop slots 38 into which the cash exchanged by the gaming establishment for chips is placed. There is also provided an area 40 for the dealer to store the gaming establishment's chips which are collected and distributed during the play of the game. Furthermore, the table layout of the present invention provides for an electronic keypad 42 for the dealer to record and keep track of additional side wagers or progressive wagers made by the bettors.

In the present version of standard baccarat, the game allows from up to 12–18 players at any one table. The table layout provided in the present invention will allow for six players maximum in a mini-bac table, and from to 6–13 players in a standard baccarat table with a progressive jackpot winner being determined by the draw of four matching cards and corresponding seat number equivalent to the four matching cards when a bet is placed in the appropriate progressive betting slot 31. Various modifications can be made to the method of play as to whether the four matching cards are required to match the bettor's corresponding seat number. The method of play can also allow for a bettor to place additional side wagers or a progressive proxy wager on a specific combination of the first 4 drawn cards not necessarily associated with the bettor's seat number by placing a bet in the appropriate proxy betting slot 32.

The baccarat bet box (FIG. 2) will be employed by the multiple players sitting about the baccarat game table. In the present version, many different and indistinguishable betting areas are found displayed on the many varied and different style of table layouts provided by each casino. In the present invention, the baccarat bet box will provide familiarity to the baccarat layout, and provide each player with an individual betting area to avoid confusion and possible loss of bets.

Figure 3:
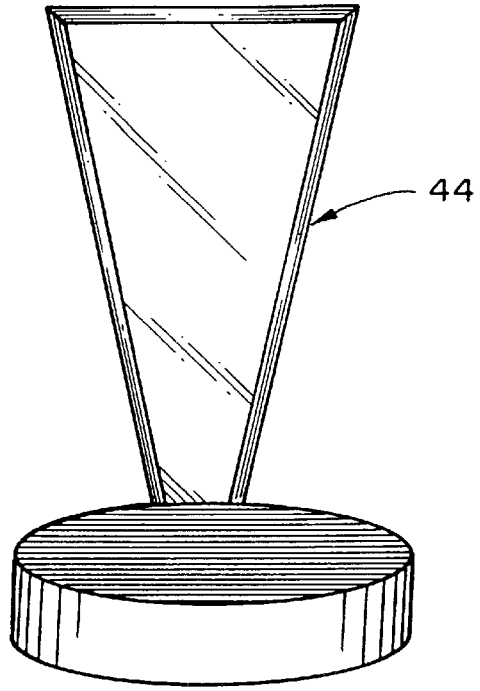
FIG. 3 is a perspective view of a type of marker that can be used during the play of our modified baccarat game method.

A baccarat marker 44 (FIG. 3) can be used to enhance the method of play by providing an opportunity for every player to cut the deck after every shuffle in an orderly manner. The baccarat marker may also be used by the dealer to mark the player to be allowed to bet first when betting in succession is utilized to control the pace of the game. The use of the baccarat marker 44 on the present modified table format provides for more interaction with the players when the gaming establishment's dealer is always dealing the cards. The marker 44 is basically a self standing object that can be placed next to a player location without being an obstruction to the game.

The modified method of play of the present invention introduces the baccarat tie call. The baccarat tie call is an innovative addition to the method of play wherein the dealer will announce that the player and the banker hands have both been dealt a pair of the same matching cards, for example, a pair of 4's to the player's hand and a pair of 4's to the banker's hand. Although it is possible that further draws may be necessary to complete the hand, the dealer's call to alert the players and supervisors of a pending additional award or progressive jackpot award will help to generate further excitement.

Figure 4:
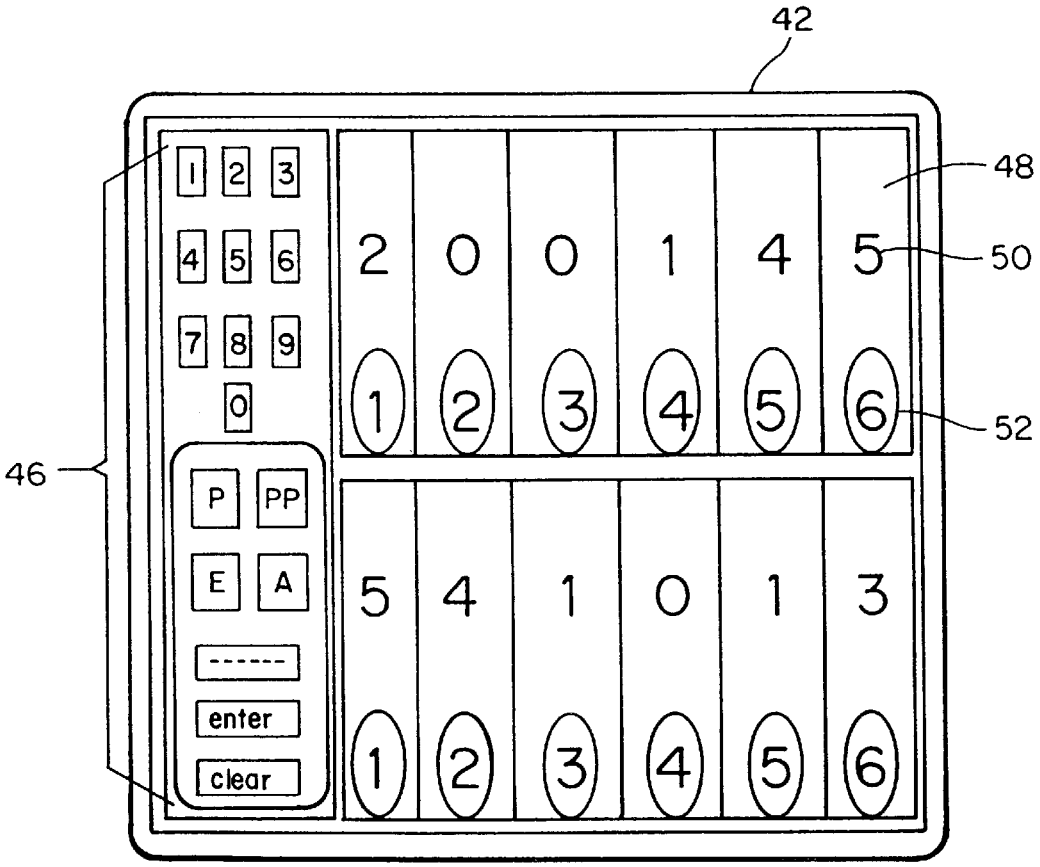
FIG. 4 is an enlarged view of an electronic keypad that can be used to record additional side wager made by the players.

In the present version of the modified game of baccarat or mini-baccarat, the game is played with 6–12 decks of cards dealt out of a holder, or shoe (not shown), as it is commonly called, after being shuffled individually by deck and collectively placed together into a stack. The cards are then dealt in the following manner:

At the commencement of play, after following the procedures for the shuffling of either 6 to 12 decks of cards, the dealer will announce, "all progressive bets in" and visually inspect the table layout for coins in each respective progressive slot 31 and slot 32 in each bet box. Each player will have the option of placing a coin in the progressive slot, and if so desired, may elect to pay in advance for future progressive bets by informing the dealer. The dealer will then record the number of bet(s) elected to be played by entering the appropriate number(s) onto an electronic keypad 42 (FIG. 4). The dealer can enter and keep track of all side wagers or progressive bets by using the electronic keypad. Such an electronic keypad will allow the dealer to enter the players' wager using keypad buttons 46. The electronic keypad will also digitally display on a screen 48 the number of additional wagers 50 each player made. Reference numerals 52 on the screen will help keep track of how many consecutive games each player position has wagered on. This particular embodiment shows two different displays to record: 1) progressive wagers (P) related to the player's seat number; and 2) progressive proxy wagers (PP) related to other numbers a player has selected to wager on. It is contemplated that various other types of methods can be employed to keep track of secondary or progressive wagers.

After all secondary wagers or progressive bets are made the dealer will then announce, "All bets down . . . , any more bets . . . , no more bets, please," and proceed to deal two cards face down to the player hand area 34 (FIG. 1), and two cards face down to the banker hand area 33. The dealer will perform this procedure by dealing the first card out of the shoe to the player hand area, the second card out of the shoe will be tucked under the top right lip of the shoe, the third card out will be dealt to the player hand area, and the fourth card out will also be tucked under the top right lip of the shoe.

After the last card is dealt out of the shoe, the dealer will turn over and expose the players' cards and announce, "the player shows (total)". The dealer will then turn over the bankers' cards and announce, "the bank has (total)". At this point, according to the following rules, the dealer will either draw or stand:

Note: All face cards and tens have a value of zero (0). Aces have a value of one (1). All others count as face value.

As explained earlier, the "total" is determined by adding the value of both cards. If the total of both cards in a hand is a two-digit number, the left digit is discarded and the right digit constitutes the "total". Example: Ace+9=10 or 0, 8+4=12, or 2.

If the point count of either hand is an 8 or 9, it is called a "natural", and no additional cards are drawn. If the banker does not have a natural, the player will always draw a third card on totals of 0-1-2-3-4 and 5, and stand with 6-7-8 and 9. The cards are dealt according to the fixed rules of standard baccarat. There are no options regarding drawing the third card for either the player's or banker's hand. No more than one additional card can be drawn to each hand. The hand closest to having a point total of 9 wins, or if both the player and banker hand results in identical totals, it is a tie and neither hand wins nor loses. The following charts describe the fixed rules governing the drawing of a third card.

Rule #1: If the initial two card player hand has a point total of 0, 1, 2, 3, 4 or 5, the player hand draws a third card. If the initial two card player hand has a point total of 6 or 7, the player hand stands and does not receive a third card.

Rule #2: If the player hand stands and does not draw a third card, then the bank hand follows Rule #1. In other words, if the player hand has a point total of 6 or 7, the bank hand draws a third card on a point total of 0, 1, 2, 3, 4 or 5 and the bank hand stands on a point total of 6 or 7.

Rule #3: If the player hand draws a third card, the bank hand must draw or stand as follows:

| Bank hand two card point total | Bank hand draws when the player's hand third card is: | Bank hand stands when the player's hand third card is: |
|---|---|---|
| 0, 1 or 2 | Bank always draws | — |
| 3 | 0, 1, 2, 3, 4, 5, 6, 7 or 9 | 8 |
| 4 | 2, 3, 4, 5, 6 or 7 | 0, 1, 8 or 9 |
| 5 | 4, 5, 6 or 7 | 0, 1, 2, 3, 8 or 9 |
| 6 | 6 or 7 | 0, 1, 2, 3, 4, 5, 8 or 9 |
| 7 | — | Bank always stands |

All third card draw determinations are automatically made by the caller who is skilled in the game of baccarat. When the rules of baccarat require a third card for the player hand, the caller will request a card for the player hand. After the player hand is completed, the bank hand is completed in the same fashion. The caller then declares which hand has the highest point total and declares that hand the winner (or the caller dclares a tie hand as the case may be).

In the present version, there are only two decisions that a bettor has to make; how much he/she wants to bet, and whether to bet on the banker hand, the player hand, or a tie. If the bettor wages on the banker hand and wins, the casino will pay the bettor 1 to 1 odds minus a 5% commission on the money won and the dealer will then keep track of the commissions by placing lammers (buttons) in the appropriate commission box or "vig" box 36 for each bettor (FIG. 1). The commission is usually paid out to the casino at the conclusion of each shoe. If the bettor wages on the player hand and wins, the bettor will be paid 1 to 1 odds without paying a 5% commission. An additional wager that can be made is a bet on the tie position (the player hand and the banker hand will end in equal totals). A winning tie wager typically pays 8 to 1 odds. This wager must also be placed before any cards are dealt for that particular hand. Tie wagers are usually limited to a maximum amount depending on the table limit.

The method of play of the present invention can have many different variations as to how the secondary or progressive wagers are made. The preferred method of play includes tying the secondary wager to a predetermined progressive jackpot. The jackpot amount would start out with a seed amount that has been determined by each casino respectively and would then progressively grow as wagers are made and a winner has not yet claimed the prize. In the preferred method of play, each player wishing to wager on the progressive jackpot would be required to place a secondary wager (in addition to a standard baccarat wager) at the beginning of each hand by placing an additional betting token in either one or both of the slots 31, 32 (FIG. 2) provided in the baccarat bet box. If the first 4 cards dealt out of the shoe at the beginning of the hand all have the same face value, the dealer would announce a baccarat tie call. If the guest sitting at the corresponding winning seat placed a progressive wager in the progressive slot 31, the guest would win the progressive jackpot. Example: If the first four cards happen to be all "fives" and the player in the fifth player position has made the secondary progressive wager, the jackpot would be paid to that player sitting in the fifth position. Moreover, if no one is found to be sitting in the winning corresponding seat number, the dealer would continue with the hand, and the progressive jackpot would not be awarded. If any of the guests sitting at the betting table placed a progressive proxy wager in the progressive proxy slot 32 and the guest selected the winning bet box or number while placing the progressive proxy wager, the guest would win the progressive proxy jackpot. Example: If the first four cards happen to be all "fours" and the player in the sixth player position had made a secondary progressive proxy wager to cover card number four, the proxy jackpot would be paid to that player, or equally distributed to all the winning players, apart from the original progressive jackpot. If no one placed a winning progressive proxy wager, the dealer would continue with the hand, and the progressive proxy jackpot would not be awarded. Since a separate jackpot award is generated by proxy participants, several players at several different tables may share in the additional progressive proxy jackpot. This proxy progressive reward will make it possible for a player to win a full or partial share of a progressive reward despite the winning seat position, the jackpot reward would be shared evenly by multiple players who wagered on the possible outcome of a four of a kind other than their own respective bet box number. This particular method of play would provide more excitement in the standard game of baccarat and encourage players to create a following towards a particular "lucky seat" number.

Figure 5:
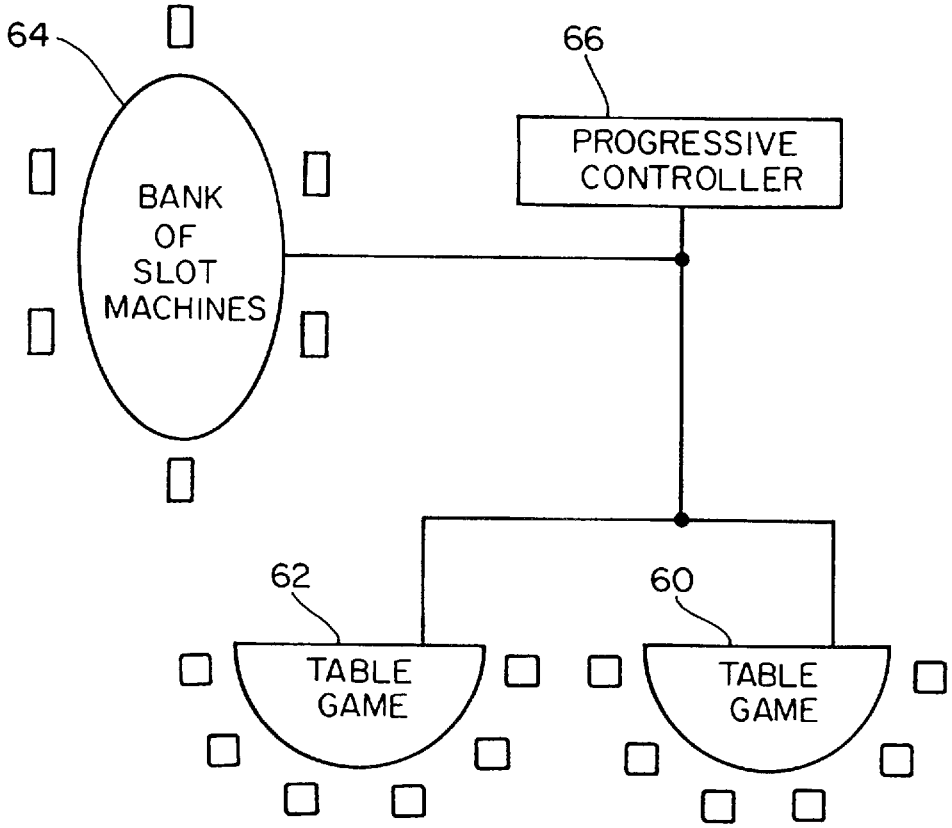
FIG. 5 is a diagram illustrating how a plurality of games can be linked together electronically to one progressive jackpot.

It is also possible and desirable to tie the progressive jackpot award to a number of other gaming tables or games, including slot machines, at one time. This would then allow a player to place progressive wagers on more than one game or table. Example: If player number four located at game table number one placed a secondary progressive wager and immediately thereafter game table number three announced a baccarat tie call for player position number four, then player number four located at game table number one would win or share the progressive jackpot. If more than one player wins the progressive jackpot then the jackpot would then be paid out proportionally among the winners in a manner defined by each gaming establishment. It would be possible to adequately monitor and track all progressive wagers for a plurality of games electronically to provide fairness and the inability for one to cheat. Furthermore, it is not required that the plurality of games tied to the baccarat progressive jackpot or the progressive proxy jackpot be the same type of game. The progressive jackpot and the progressive proxy jackpot can be applied to one or more of the following games: baccarat, mini-baccarat, craps, roulette, blackjack, poker, slot machines and any other types of casino games. These particular types of jackpots allow for players to create a loyalty following for a particular number at games other than baccarat. FIG. 5 illustrates how a plurality of games can be tied together electronically to one progressive jackpot. Table games 60, 62, such as baccarat, mini-baccarat, craps, roulette, blackjack and poker, and a bank of slot machines 64, can be tied together electronically with wires 64 to a computerized progressive betting controller 66 that is able to accurately keep a running count of the progressive jackpot as players are placing wagers at their respective locations.

As various possible embodiments may be made in the above invention for use for different purposes and as various changes might be made in the embodiments and method above set forth, it is understood that all of the above matters here set forth or shown in the accompanying drawings are to be interpreted as illustrative and not in a limiting sense.

We claim:

1. An improved method of playing the conventional manner of play of baccarat in which a bettor makes a first wager that either a bank hand or player hand will win, the improvement comprising:

a) the bettor having the option of making a second wager that the bank hand and the player hand will comprise in combination a four-of-a-kind of a specific card value in which the specific card value is determined by a seat location number at which the bettor is located;

b) dealing two cards comprising the bank hand and dealing two cards comprising the player hand according to the conventional manner of play of baccarat;

c) determining whether the combination of the bank hand and the player hand is a four-of-a-kind of the specific card value;

d) paying off the bettor a predetermined amount if the bettor's second wager was a winning wager wherein the combination of the bank hand and the player hand is a four-of-a-kind of the specific card value;

e) dealing an additional card to the player hand and an additional card to the bank hand if required according to the conventional manner of play of baccarat;

f) determining a winning hand and a losing hand according to the conventional manner of play of baccarat;

g) paying off the bettor a predetermined amount if the bettor's first wager was on the winning hand according to the conventional manner of play of baccarat and collecting the amount wagered on the losing hand.

2. The method of claim 1 in which the second wager is apportioned to a progressive jackpot and the bettor is paid a predetermined amount from the progressive jackpot if the bettor has made a winning wager on the second wager.

3. The method of claim 2 in which the second wager enables the bettor to win the progressive jackpot if a winning event occurs on a predetermined number of other games being played at the same time including: baccarat, mini-baccarat, roulette, craps, blackjack, poker, or slots.

4. The method of claim 3 in which the winning event is determined by a seat number at which the bettor is located.

5. The method of claim 1 further comprising:

a) allowing the bettor to place additional wagers on the second wager and applying the additional wagers to future games;

b) recording the bettor's second wager and any additional wagers.

6. The method of claim 5 in which the bettor's second wager and any additional wagers are recorded on an electronic keypad.

7. The method of claim 6 in which the second wagers of multiple bettors can be recorded.

8. An improved method of playing the conventional manner of play of baccarat in which a bettor makes a first wager that either a bank hand or player hand will win, the improvement comprising:

a) the bettor having the option of making a second wager that the bank hand and the player hand will comprise in combination a four-of-a-kind of a card value equivalent to a seat number at which the bettor is located;

b) dealing two cards comprising the bank hand and dealing two cards comprising the player hand according to the conventional manner of play of baccarat;

c) determining whether the combination of the bank hand and the player hand is a four-of-a-kind and whether the card value in the four-of-a-kind is equivalent to the seat number at which the bettor is located;

d) paying off the bettor a predetermined amount if the bettor's second wager was a winning wager wherein the combination of the bank hand and the player hand is a four-of-a-kind and the card value in the four-of-a-kind is equivalent to the seat number at which the bettor is located;

e) dealing an additional card to the player hand and an additional card to the bank hand if required according to the conventional manner of play of baccarat;

f) determining a winning hand and a losing hand according to the conventional manner of play of baccarat;

g) paying off the bettor a predetermined amount if the bettor's first wager was on the winning hand according to the conventional manner of play of baccarat and collecting the amount wagered on the losing hand.

9. The method of claim 8 in which the second wager is apportioned to a progressive jackpot and the bettor is paid a predetermined amount from the progressive jackpot if the bettor has made a winning wager on the second wager.

10. The method of claim 9 in which the second wager enables the bettor to win the progressive jackpot if a winning event occurs on a predetermined number of other games being played at the same time including: baccarat, mini-baccarat, roulette, craps, blackjack, poker, or slots.

11. The method of claim 8 further comprising:

a) allowing the bettor to place additional wagers on the second wager and applying the additional wagers to future games;

b) recording the bettor's second wager and any additional wagers.

12. The method of claim 11 in which the bettor's second wager and any additional wagers are recorded on an electronic keypad.

13. The method of claim 12 in which the second wagers of multiple bettors can be recorded.

* * * * *